US006963038B1

(12) United States Patent
Simon et al.

(10) Patent No.: US 6,963,038 B1
(45) Date of Patent: Nov. 8, 2005

(54) LIQUID METAL CONTACT MICRORELAY

(75) Inventors: Jonathan Simon, Castro Valley, CA (US); Steven A. Rosenau, Mountain View, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/857,306

(22) Filed: May 28, 2004

(51) Int. Cl.[7] ..... H01H 29/00
(52) U.S. Cl. ..... 200/182; 200/193
(58) Field of Search ..... 200/182, 183, 200/187–191, 209–219, 233–236

(56) References Cited

U.S. PATENT DOCUMENTS 4,652,710 A * 3/1987 Karnowsky et al. ..... 200/235
6,506,989 B2 * 1/2003 Wang ..... 200/181
6,671,078 B2 * 12/2003 Flanders et al. ..... 359/254
6,774,325 B1 * 8/2004 Wong et al. ..... 200/182
6,781,074 B1 * 8/2004 Fong et al. ..... 200/182
6,787,719 B2 * 9/2004 Wong ..... 200/182

* cited by examiner

*Primary Examiner*—Elvin G. Enad
*Assistant Examiner*—Lisa Klaus
(74) *Attorney, Agent, or Firm*—Juergen Krause-Polstorf

(57) ABSTRACT

Liquid metal microrelays may be made where a contact is formed by constraining a quantity of liquid metal at the end of a contact support suspended over a substrate. Movement of the contact support typically drags the liquid metal along the surface of the substrate and allows the liquid metal to bridge contacts located on the substrate. Coplanar waveguides may be used for the switched signal instead of microstrip transmission lines to reduce transmission line discontinuities due to impedance changes.

21 Claims, 5 Drawing Sheets

LIQUID METAL CONTACT MICRORELAY

CROSS-REFERENCE TO RELATED APPLICATIONS

This application relates to the co-pending application Ser. No. 10/857,205, filed on the same day, entitled "A Liquid Metal Contact Reed Relay With Integrated Electromagnetic Actuator" by Simon and Rosenau owned by the assignee of this application and incorporated herein by reference.

BACKGROUND

A reed relay is a common type of relay. The reed relay includes one or more thin cantilevered metal arms or reeds made of paramagnetic material such as permalloy (typically 80% nickel, 20% iron). In the presence of a magnetic field, the reeds experience a force and move to make contact with one another or another electrode to complete a circuit. While these relays can be used to switch DC signals for powering devices, AC signal switching applications dominate the areas of application for small reed relays. Reed relays have the ability to handle large currents, have long lifetimes, typically more than $1\times10^8$ cycles, relatively low cost, moderate contact resistance and good isolation.

However, reed relays typically have a number of drawbacks. There is typically a lower bound on the size of reed relay because of the space occupied by the winding of the electromagnetic actuator. The presence of the lower bound on the size of the reed relay typically limits switching speed and unless designed to mechanically latch, the inductive nature of the relay requires that significant power is typically required for the relay to remain latched. Electromechanical bounce issues may exist that impart noise into the switched signal along with contact wear issues for reed relays. Additionally, reed relays cannot operate at frequencies greater than about 5 GHz.

A way to improve the performance of a reed relay is to coat the electrodes with liquid mercury, thereby replacing a solid—solid contact with a liquid—liquid contact. A liquid—liquid contact provides a number of advantages by removing the electromechanical bounce issues associated with solid—solid contact; eliminating most of the contact wear issues because the liquid is refreshed every time the relay is actuated; the actuating force required to make a good contact is typically reduced; and the contact resistance and insertion loss is reduced. However, in a liquid—liquid contact the surface tension forces which need to be overcome typically tend to dominate as the relay size is scaled down, thereby setting a limit on switching speed.

MEMS (MicroElectroMechanical Systems) techniques have been introduced to improve the speed, lower the cost and provide multiple relays in a compact package, allowing reed relays to be made at sizes on the order of a few square millimeters. Reduced size allows some reed relays to be capable of operating at switching speeds greater than about 1 kHz. However, typically contact resistance is high due to the low contact forces that are possible with the typical electrostatic actuation. Some MEMS relays have higher force actuators but typically sacrifice speed and lifetime.

Some contact related limitations have been addressed by liquid metal microrelays, such as those disclosed, for example, in U.S. Patent Publication 20030201855 A1, which are latching MEMS relays that depend on a thermal actuator and all liquid contact to lower the insertion loss. Because the relay is latching, no power is required for the relay to remain actuated. The liquid metal microrelays are suitable for radio frequency (RF) signals and typically provide a bandwidth of 18 GHz. However, liquid metal microrelays have several problems. The thermal actuator cannot typically be repeatedly operated without heat buildup because the thermal actuator heats up much more quickly than it cools and this places an upper bound on how rapidly the relay may be cycled. Liquid metal microrelays are also typically sensitive to the amount of liquid mercury they contain and the volume of mercury involved is typically relatively large compared to the relay volume.

SUMMARY OF THE INVENTION

In accordance with the invention, a contact made by constraining a quantity of liquid metal at the end of a contact support suspended over a substrate is used to make liquid metal microrelays. Movement of the contact support typically drags the liquid metal along the surface of the substrate and allows the liquid metal to bridge contacts located on the substrate. Coplanar waveguides may be used for the switched signal instead of microstrip transmission lines to reduce transmission line discontinuities due to impedance changes.

DETAILED DESCRIPTION OF THE INVENTION

Figure 1:
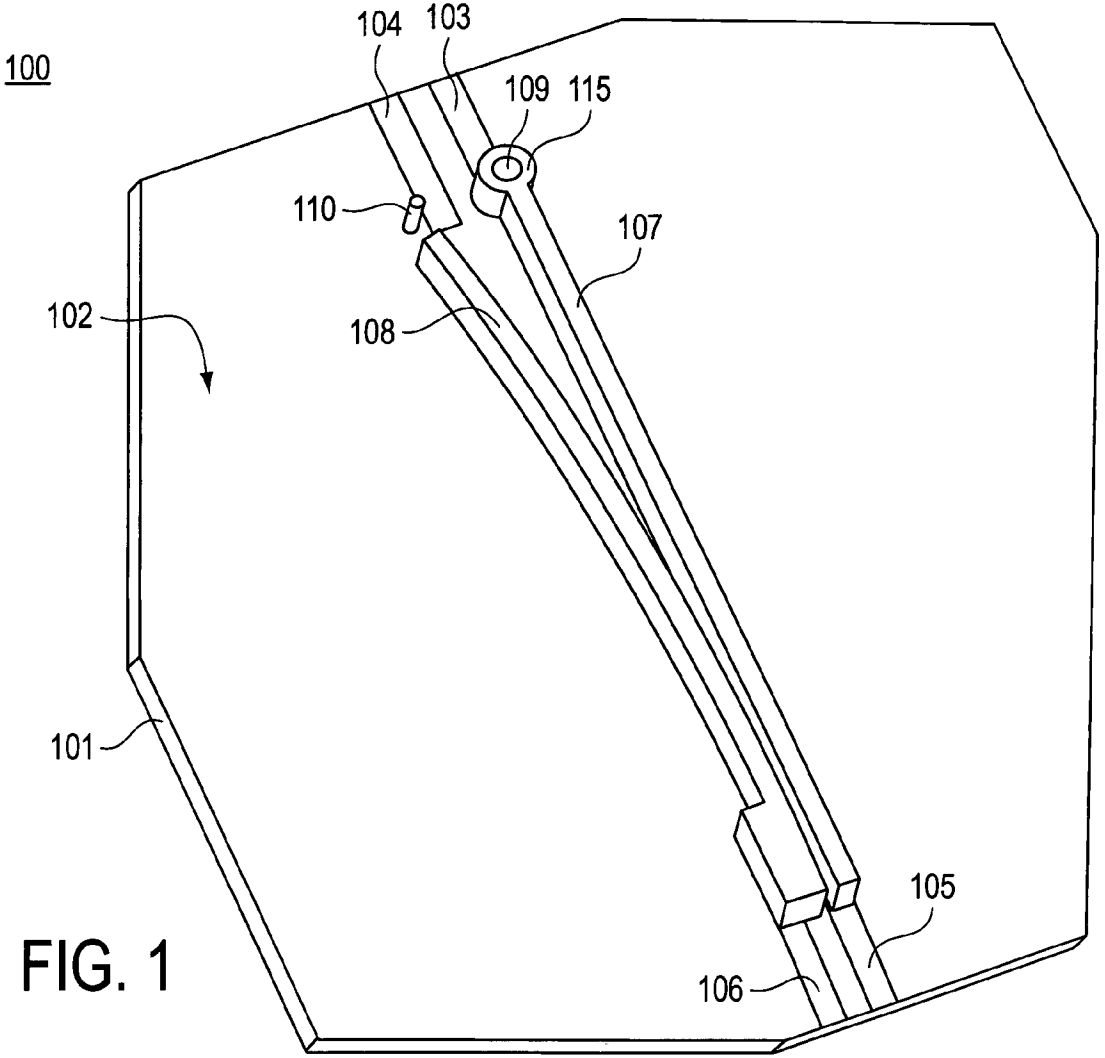
FIG. 1 shows an embodiment in accordance with the invention.

An embodiment in accordance with the invention using an electrostatic MEMS cantilever relay with a dragged contact is shown in FIG. 1 in a first position. Dragged contact 109 is typically mercury but may also be a gallium alloy. Microrelay 100 provides for small scale, high switching speed (greater than about 1 kHz) operation and is suitable for switching radio frequency switching operations. Use of typical lithographic techniques such as those disclosed in "Fundamentals of Microfabrication: The Science of Miniaturization", Marc Madou, CRC Press, 2002, allows many thousands of liquid metal microrelays 100 to be fabricated in parallel and multiple microrelays 100 may be integrated into a single package allowing for added capabilities. Alternative embodiments in accordance with the invention include comb drive structures typically requiring larger die but lower operating voltages.

Microrelay 100 is typically a single poll, double throw relay although other configurations are possible such as, for example, single poll, single throw; double poll, single throw and double poll, double throw relays. Microrelay 100 includes substrate 101, signal electrodes 103, 104, 105, switching electrode 106, cantilever 107 and stator 108. Signal electrodes 103, 104, 105 and switching electrode 106 are fabricated on upper surface 102 of substrate 101, typically silicon or other suitable dielectric. Cantilever 107 is typically made of nickel by electroplating and is electrically coupled to signal electrode 105 and has a typical linear dimension on the order of 1 mm, a typical height on the order of 25 μm and a width on the order of 10 μm. Cantilever 107 has well region 115 at one end with a typical inner diameter on the order of 25 μm that holds dragged contact 109, typically a drop of mercury that makes contact with upper surface 102 of substrate 101. Well region 115 may have a circular, elliptical or other suitable shape in accordance with the invention. Stator 108 is typically fabricated from electroplated nickel and typically has dimensions on the order of cantilever 107. Stator 108 is electrically coupled to switching electrode 106.

Figure 2:
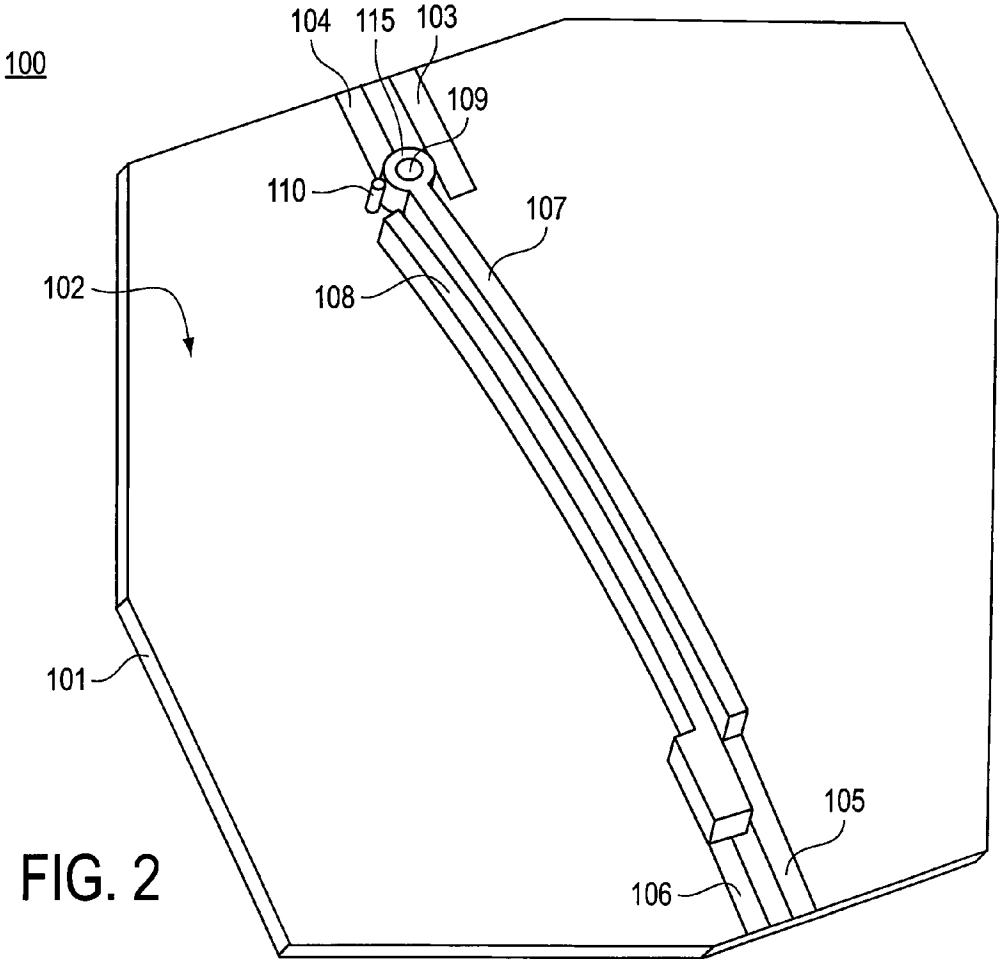
FIG. 2 shows an embodiment in accordance with the invention.

FIG. 2 shows microrelay 100 in a second position. Application of a switching voltage, typically on the order of 100 V, between cantilever 107 and stator 108 causes cantilever 107 to move towards stator 108 due to an electrostatic force on the order of 200 μN. Dragged contact 109 is moved until dragged contact 109 couples signal electrodes 104, 105 to create a closed circuit. Stop 110 prevents cantilever 107 from contacting stator 108. Removal of the switching voltage results in the return of cantilever 107 to its non-actuated position because of the elastic restoring force in bent cantilever 107 which is on the order of 200 μN.

Figure 3:
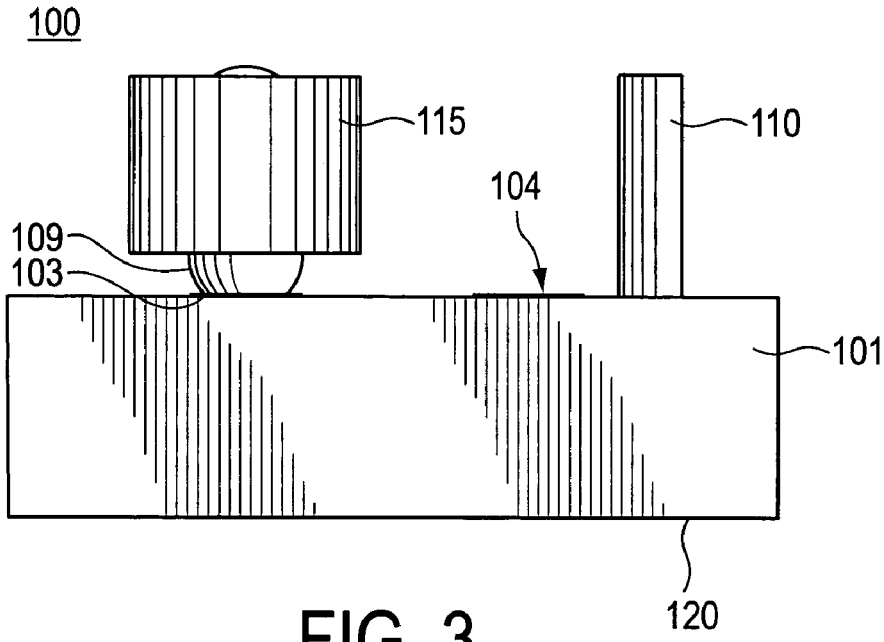
FIG. 3 shows a side view of an embodiment in accordance with the invention.
Figure 4:
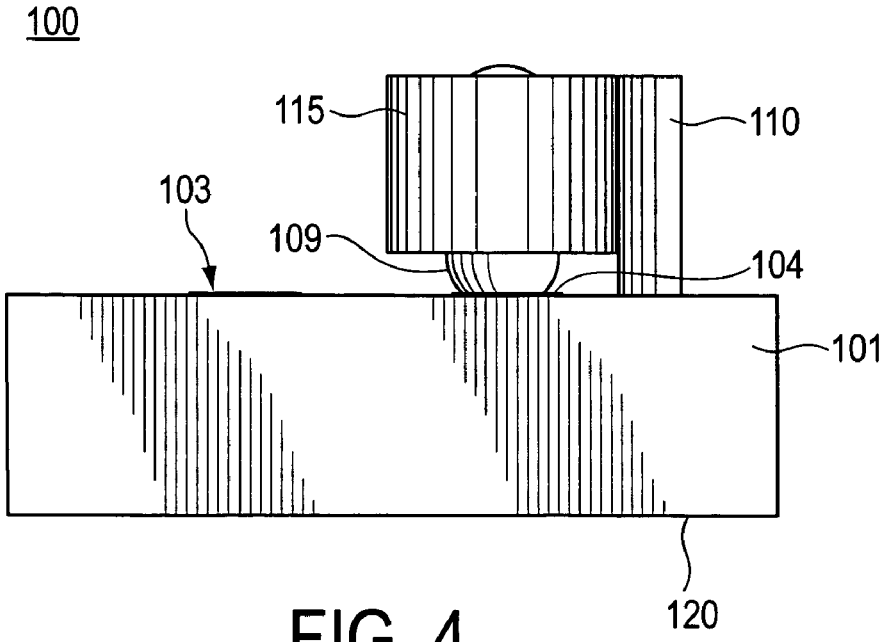
FIG. 4 shows a side view of an embodiment in accordance with the invention.

FIG. 3 shows a cross-section of microrelay 100 in a first position in accordance with an embodiment of the invention. FIG. 4 shows a cross-section of microrelay 100 in the second position. Ground plane 120, typically a thin metal layer of aluminum (Al) or aluminum silicide, gold (Au), copper (Cu) or other suitable conductor covers the bottom surface of substrate 101. A barrier/adhesion layer on the order of hundreds of angstroms, such as a Ti—Pt, Ti—W or Cr layer, is typically used between ground plane 120 and substrate 101.

If signal electrodes 103, 104, 105 and cantilever 107 are microstrips, large discontinuities resulting in impedance variations are typically present at each end of cantilever 107 because of the changing distances to ground plane 120 (see FIGS. 3–4) as the signal transitions from signal electrodes 104 or 103 and signal electrode 105 on substrate surface 102 to cantilever 107. Additionally, the proximity of stator 108 to cantilever 107 produces an additional discontinuity in the transmission in cantilever 107 and this additional discontinuity depends on whether cantilever 107 in microswitch 100 is in the first or second position.

Figure 5:
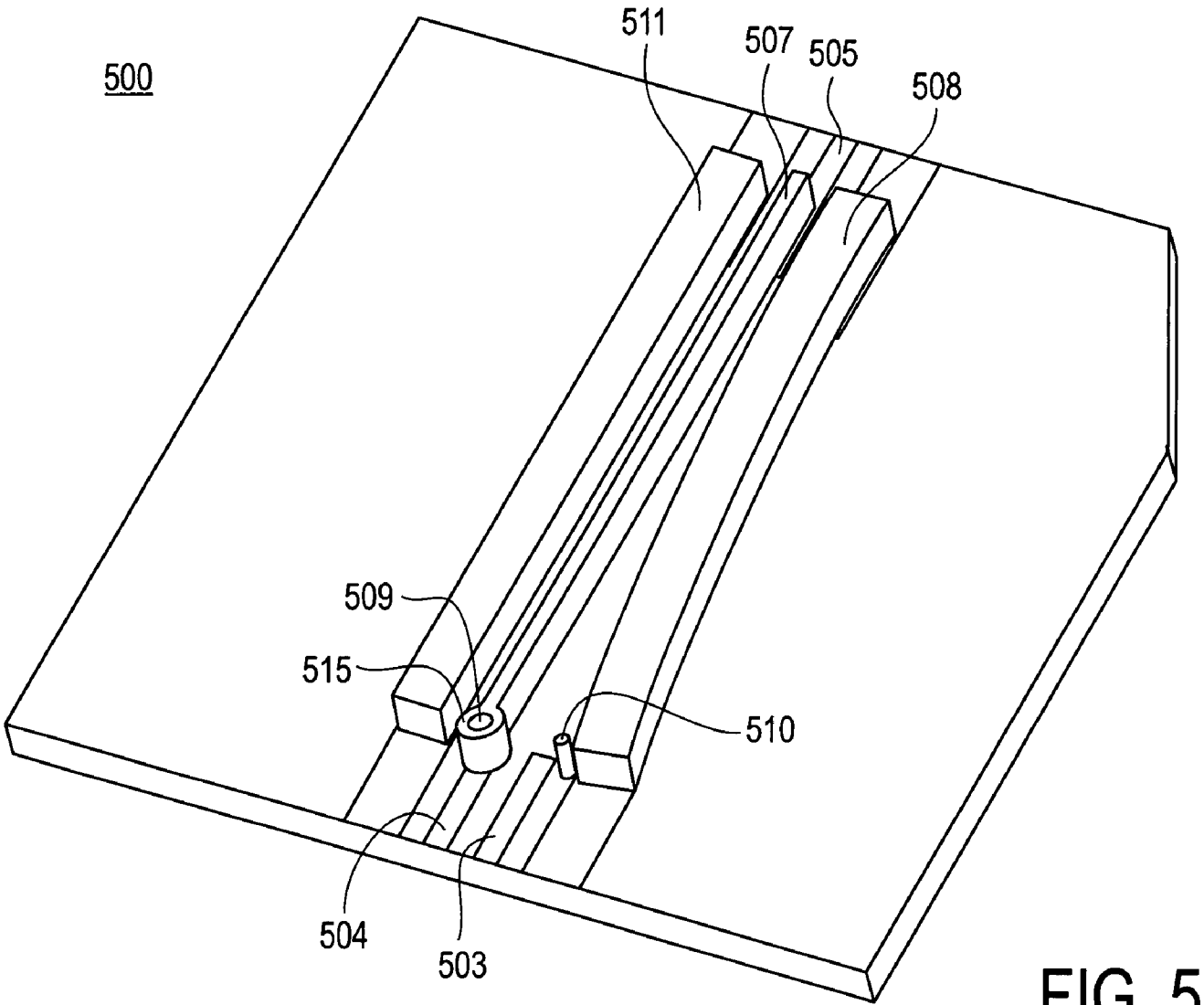
FIG. 5 shows an embodiment in accordance with the invention that reduces discontinuities in signal transmission.
Figure 6:
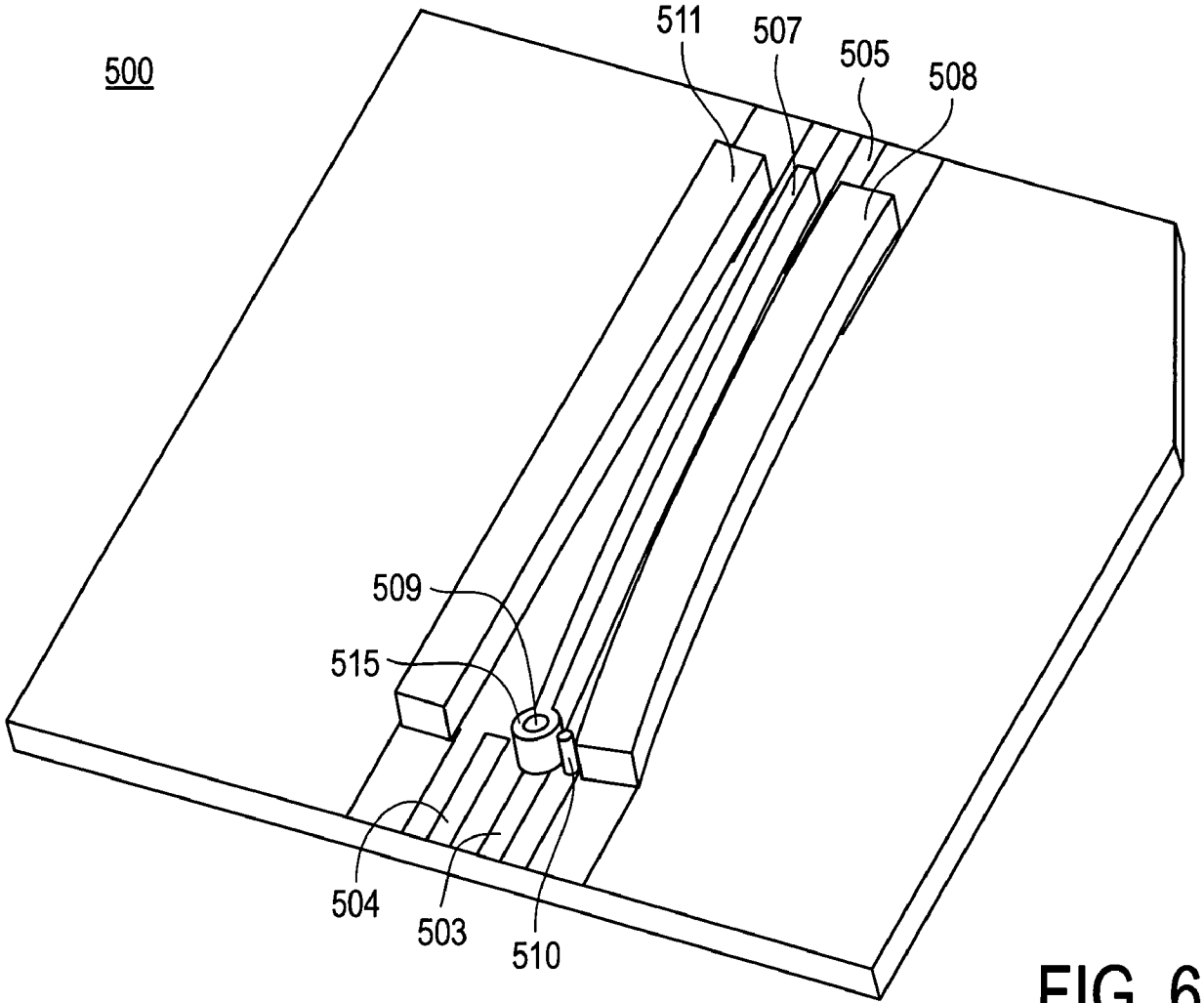
FIG. 6 shows an embodiment in accordance with the invention that reduces discontinuities in signal transmission.

FIGS. 5 and 6 show an embodiment in accordance with the invention to reduce the discontinuity problems that result in impedance variations, particularly at frequencies higher than about 2 GHz. The numerical parameters for the embodiments in FIGS. 5 and 6 are on the order of those discussed above in connection with the embodiments shown in FIGS. 1–4. Making signal electrodes 503, 504, 505 along with cantilever 507 co-planar waveguides by introducing second stator 511 as shown in FIG. 5 avoids the large discontinuities due to transmission line impedance. Stators 508 and 511 can both be part of the RF ground while carrying the DC voltage required to electrostatically switch the position of cantilever 507 between signal electrodes 503 and 504. Stators 511 and 508 are dimensionally sized on the order of magnitude of cantilever 507 dimensions. Cantilever 507 has well region 515 at one end with a typical inner diameter on the order of 25 μm that holds dragged contact 509, typically a drop of mercury. The use of stators 511 and 508 as RF ground ensures that the distance between the signal trace and RF ground does not significantly change. Use of dual stators 508 and 511 also allows forced switching of microrelay 500 to avoid stiction instead of relying on the spring constant, typically about 1 N/m of cantilever 507 to return cantilever 507 to the first position. Stop 510 prevents cantilever 507 from contacting stator 508. If forced switching is used, a second stop (not shown) is typically introduced to prevent stator 511 from contacting cantilever 507. Either the first or second position of mircorelay 500 can be obtained by appropriate biasing of stators 508 and 511. However, only stator 508 is necessary for microrelay 500 while stator 511 may serve only as part of the RF ground to avoid discontinuities.

Stators 511 and 508 are typically designed to ensure that the transmission line characteristic impedance along cantilever 507 is substantially independent of whether microrelay 500 is in the first or second position. This is typically accomplished by appropriately adjusting the curvature of stators 511 and 508 to adjust the distance between cantilever 507 and stators 511 and 508 to achieve an approximately constant transmission line characteristic impedance. For example, for purposes of illustration, FIG. 5 shows stator 511 having no curvature to match the lack of curvature of cantilever 507 in the first position and FIG. 6 shows stator 508 having a curvature to match the curvature of cantilever 507 in the second position. Typically, however, the curvature of stators 511 and 508 are not selected to match the curvature of cantilever 507 in the first and second positions, respectively, but rather the curvatures of stators 508 and 511 are selected to provide for an approximately constant transmission line characteristic impedance along the signal path for microrelay 500.

While the invention has been described in conjunction with specific embodiments, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

What is claimed is:

1. A microrelay comprising:

a substrate having a first and a second surface;

a plurality of electrodes disposed on said first surface of said substrate;

a first stator disposed on said first surface of said substrate and electrically coupled to a fourth one of said plurality of electrodes;

a cantilever disposed on said first surface of said substrate and oriented substantially parallel to said first stator, said cantilever having a first and a second end, said first end electrically coupled to a first one of said plurality of electrodes and said second end capable of electrically coupling to a second one or third one of said plurality of electrodes; and a well disposed at said second end of said cantilever, said well formed to contain a dragged contact.

2. The microrelay of claim 1 wherein said dragged contact comprises liquid mercury.

3. The microrelay of claim 1 wherein said second surface of said substrate comprises a ground plane.

4. The microrelay of claim 1 wherein said dragged contact comprises a gallium alloy.

5. The microrelay of claim 3 wherein said ground plane is comprised of gold.

6. The microrelay of claim 1 further comprising a stop to prevent said cantilever from contacting said first stator.

7. The microrelay of claim 1 wherein said well is substantially circular in shape.

8. The microrelay of claim 1 wherein said cantilever is comprised of nickel.

9. The microrelay of claim 1 wherein said first stator is curved.

10. The microrelay of claim 9 wherein said second stator electrically couples a first electrode on said first surface of said substrate to a second electrode on said first surface of said substrate.

11. The microrelay of claim 9 wherein said first stator and said second stator are operable to move said second end of said cantilever between said second or said third one of said plurality of electrodes.

12. The microrelay of claim 1 further comprising a second stator disposed on said first surface of said substrate substantially parallel to said cantilever and said first stator.

13. A method for making a microrelay comprising:

providing a substrate having a first and a second surface;

placing a plurality of electrodes on said first surface of said substrate;

placing a first stator on said first surface of said substrate such that said stator is electrically coupled to a fourth one of said plurality of electrodes;

placing a cantilever on said first surface of said substrate such that said cantilever is oriented substantially parallel to said first stator, said cantilever having a first and a second end, said first end electrically coupled to a first one of said plurality of electrodes and said second end capable of electrically coupling to a second one or third one of said plurality of electrodes; and forming a well disposed at said second end of said cantilever, said well formed to contain a dragged contact.

14. The method of claim 13 wherein said dragged contact comprises liquid mercury.

15. The method of claim 13 wherein said second surface of said substrate comprises a ground plane.

16. The method of claim 13 further comprising placing a stop on said first surface of said substrate to prevent said cantilever from contacting said first stator.

17. The method of claim 13 wherein said first stator is curved.

18. The method of claim 13 wherein said well is substantially circular in shape.

19. The method of claim 18 wherein said second stator is placed to electrically couple a first electrode on said first surface of said substrate to a second electrode on said first surface of said substrate.

20. The method of claim 18 wherein said first stator and said second stator are operable to move said second end of said cantilever between said second or said third one of said plurality of electrodes.

21. The method of claim 13 further comprising placing a second stator on said first surface of said substrate substantially parallel to said cantilever and said first stator.

* * * * *

UNITED STATES PATENT AND TRADEMARK OFFICE

CERTIFICATE OF CORRECTION

PATENT NO. : 6,963,038 B1
DATED : November 8, 2005
INVENTOR(S) : Simon et al.

It is certified that error appears in the above-identified patent and that said Letters Patent is hereby corrected as shown below:

Title page,
Item [74], *Attorney, Agent, or Firm*, after "Krause-" delete "Polstorf" and insert -- Polstorff --.

Signed and Sealed this

Fourth Day of April, 2006

JON W. DUDAS
*Director of the United States Patent and Trademark Office*